US007926615B2

(12) United States Patent
Smatloch et al.

(10) Patent No.: US 7,926,615 B2
(45) Date of Patent: Apr. 19, 2011

(54) METHOD OF MAKING AN EXHAUST-NOISE ATTENUATION MUFFLER, AND EXHAUST-NOISE ATTENUATION MUFFLER

(75) Inventors: Christian Smatloch, Paderborn (DE); Pieter Van Den Eijkel, Würselen (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 12/361,167

(22) Filed: Jan. 28, 2009

(65) Prior Publication Data

US 2009/0188747 A1 Jul. 30, 2009

(30) Foreign Application Priority Data

Jan. 28, 2008 (DE) ..... 10 2008 006 401

(51) Int. Cl.

| | |
|---|---|
| ***F01N 1/02*** | (2006.01) |
| ***F01N 1/08*** | (2006.01) |
| ***F01N 5/00*** | (2006.01) |
| ***F01N 13/08*** | (2006.01) |
| ***F01N 13/18*** | (2006.01) |

(52) U.S. Cl. ..... 181/282; 181/211; 181/228; 181/243; 181/250; 181/268; 181/272

(58) Field of Classification Search ..... 181/282, 181/211, 228, 243, 250, 268, 272; 72/348
See application file for complete search history.

(56) References Cited

U.S. PATENT DOCUMENTS

| | | | | |
|---|---|---|---|---|
| 1,701,397 A | | 2/1929 | Trumble et al. | |
| 2,315,305 A | * | 3/1943 | Van Voorhees | 181/268 |
| 2,835,336 A | * | 5/1958 | Deremer | 181/282 |
| 4,598,790 A | | 7/1986 | Uesugi et al. | |
| 4,759,423 A | * | 7/1988 | Harwood et al. | 181/282 |
| 4,821,840 A | * | 4/1989 | Harwood et al. | 181/282 |
| 4,860,853 A | * | 8/1989 | Moring, III | 181/282 |
| 4,865,154 A | * | 9/1989 | Hanson et al. | 181/282 |
| 4,924,968 A | * | 5/1990 | Moring et al. | 181/282 |
| 5,004,069 A | * | 4/1991 | Van Blaircum et al. | 181/282 |
| 5,012,891 A | * | 5/1991 | Macaluso | 181/282 |
| 5,164,551 A | * | 11/1992 | Harwood et al. | 181/238 |
| 5,229,557 A | * | 7/1993 | Allman et al. | 181/282 |
| 5,280,142 A | * | 1/1994 | Keller | 181/211 |
| 5,448,831 A | * | 9/1995 | Harwood | 29/890.08 |
| 5,597,986 A | * | 1/1997 | Harwood et al. | 181/282 |
| 5,859,394 A | * | 1/1999 | Seehaus et al. | 181/282 |
| 5,996,730 A | * | 12/1999 | Pirchl | 181/211 |
| 6,659,222 B1 | * | 12/2003 | Allman | 181/282 |
| 6,892,855 B2 | * | 5/2005 | Warmenhoven | 181/282 |

(Continued)

FOREIGN PATENT DOCUMENTS

| | | |
|---|---|---|
| EP | 0 523 008 A | 1/1993 |
| WO | WO 01/65078 A | 9/2001 |

*Primary Examiner* — Edgardo San Martin
*Assistant Examiner* — Christina Russell
(74) *Attorney, Agent, or Firm* — Henry M. Feiereisen; Ursula B. Day

(57) ABSTRACT

An exhaust-noise attenuation muffler includes two half-shells, each including an inner shell and an outer shell which are made through deep drawing of a sheet metal blank which can have a thickness between 0.3 mm and 0.5 m. The inner shell or the outer shell is provided with an embossment. After placing the inner shells in corresponding ones of the outer shells to form half-shells, two complementing half-shells are joined together.

21 Claims, 7 Drawing Sheets

U.S. PATENT DOCUMENTS 7,273,129 B2 * 9/2007 Harwood ..... 181/256
2004/0166296 A1 * 8/2004 Ragland et al. ..... 428/209
2008/0292832 A1 * 11/2008 Zika-Beyerlein et al. ..... 428/91
2010/0035078 A1 * 2/2010 Staudt et al. ..... 428/596

* cited by examiner

METHOD OF MAKING AN EXHAUST-NOISE ATTENUATION MUFFLER, AND EXHAUST-NOISE ATTENUATION MUFFLER

CROSS-REFERENCES TO RELATED APPLICATIONS

This application claims the priority of German Patent Application, Serial No. 10 2008 006 401.7, filed Jan. 28, 2008, pursuant to 35 U.S.C. 119(a)-(d), the content of which is incorporated herein by reference in its entirety as if fully set forth herein.

BACKGROUND OF THE INVENTION

The present invention relates to a method of making an exhaust-noise attenuation muffler, and to an exhaust-noise attenuation muffler.

Mufflers are used to attenuate the transmission of sound waves in exhaust systems of internal combustion engines. U.S. Pat. No. 2,835,336 describes a silencer or a muffler which includes a shell formed with double walls. The outer wall is formed with spaced grooves to provide a plurality of spaced ridges, thereby maintaining the inner and outer walls at a distance and providing obstructions to interrupt sound waves. The inner and outer walls are made of metal sheets which are joined by an overlapping interlocking seam. Common to conventional mufflers is their substantial weight which is determined by the thickness of the used metal sheets. Typically, the thickness ranges from 0.7 mm to 1.2 mm. This substantial weight of conventional mufflers adversely affects fuel consumption. Also, there are limitations to the design options, as a consequence of the manufacturing process.

It would therefore be desirable and advantageous to provide an improved method of making an exhaust-noise attenuation muffler and to provide an improved an exhaust-noise attenuation muffler to obviate prior art shortcomings.

SUMMARY OF THE INVENTION

According to one aspect of the present invention, a method of making an exhaust-noise attenuation muffler includes the steps of deep drawing sheet metal blanks to form plural inner shells and plural outer shells, forming at least one embossment in one inner shell and/or outer shell, placing the inner shells in corresponding ones of the outer shells to form half-shells, and joining two complementing half-shells.

The present invention resolves prior art problems by forming the embossments after the deep drawing step, as opposed to during the deep drawing process. As a result, the deep drawing process is no longer subject to limitations, caused by the incorporation of embossments. The use of inexpensive materials is possible as the degree of deformation is less. Moreover, the thickness of the sheet metal blanks can be reduced, resulting in weight savings, and the freedom of design is greatly expanded so that a greater number of shapes may be produced.

According to another aspect of the present invention, an exhaust-noise attenuation muffler includes two half-shells, each including an inner shell and an outer shell made through deep drawing of a sheet metal blank, with the inner shell or the outer shell provided with an embossment, wherein one sheet metal blank has a thickness between 0.3 mm and 0.5 mm.

An exhaust-noise attenuation muffler according to the invention can be produced efficiently and inexpensively and is lightweight. As the embossments are made after the deep drawing process in the inner shell and/or outer shell, the design of the muffler can be suited to the requirements at hand, without the need for using expensive materials. In view of the reduced thickness of the sheet metal blank, the overall weight is also decreased. This benefits fuel consumption and manufacturing costs of the muffler.

According to another advantageous feature of the present invention, embossments may be formed at corresponding areas in an inner shell and an outer shell to define a channel. The inner shell is hereby formed with an embossment which is directed inwardly towards the center of the later muffler, whereas the outer shell is formed at the same location with an embossment which is directed outwards. As a result, a channel is formed which extends, for example in the form of a tube across the casing of a half-shell. It is, of course, also conceivable to provide the casing of a half-shell with several such channels so as to provide the casing with a cross sectional shape that resembles an air mattress. In this way, the cross sectional stiffness of the half-shells is advantageously enhanced.

According to another advantageous feature of the present invention, at least one intermediate shell may be arranged between an inner shell and an outer shell. The provision of the intermediate shell allows production of a multi-layered exhaust-noise attenuation muffler and may be used to positively influence attenuation and noise transmission behavior.

According to another advantageous feature of the present invention, at least one sheet metal blank has a thickness between 0.3 mm and 0.5 mm. The slight thickness not only results in a lower weight of the exhaust-noise attenuation muffler being produced but also positively affects the transmission capability of exhaust noise. The reduction in thickness is made possible because the inner shell assumes a support function in addition to the outer shell.

According to another advantageous feature of the present invention, the sheet metal blank may be a tailored blank. Tailored blanks are also known as patchwork blanks and involve metal sheets which are joined together of several sheet parts welded along the edges. As a result, the thickness of the sheet metal blanks can be suited to the expected stress situation and increased in those areas which are subject to greater mechanical stress, e.g. in the area of the exhaust inlet, exhaust outlet, or a suspension.

According to another advantageous feature of the present invention, the inner shells, outer shells, and/or intermediate shells have zones which transmit radiating noise and which can be made thinner. In this way, the transmission of sound waves from the inner side of the exhaust-noise attenuation muffler to the outer side is facilitated. This may be used to configure the exhaust noise, i.e. to render possible a sound design.

According to another advantageous feature of the present invention, the sheet metal blanks may be made of different materials. This allows production of a cost-efficient exhaust-noise attenuation muffler because the need for using expensive material can be limited to only those areas of the inner walls which are subjected to great stress. The outer shells may be made of more cost-efficient material.

According to another advantageous feature of the present invention, insulating material may be arranged between the inner shells, outer shells, and/or intermediate shells. This insulating material is used as sound and/or heat insulation.

According to another advantageous feature of the present invention, the inner shell, outer shell, and/or intermediate shell of a half-shell can be joined in a region of their casings, at least in some areas, before or during joining of the half-shells. This enhances stability and stiffness of the exhaust-noise attenuation muffler. In addition, disturbing noise, in particular rattling noise, caused when the inner and outer shells strike each other, are avoided.

According to another advantageous feature of the present invention, the inner shell, outer shell, and/or intermediate shell may include an opening, e.g. made by drilling. The opening can be used for many tasks. For example, the opening may serve as drain opening for condensate which collects typically during operation of the internal combustion engine in an exhaust-noise attenuation muffler at its lowermost point. Failure to drain condensate causes premature corrosion of the muffler. Of course, instead of a drain opening, attachment of a condensate removal device in the muffler may also be conceivable for discharge of condensate through an exhaust outlet opening. Sound may also propagate from the inner space of the muffler into the channel or channels between the inner shell and the outer shell through the opening and reflect there to silence or attenuate the exhaust noise.

According to another advantageous feature of the present invention, several embossments may be formed in the inner shell, outer shell, and/or intermediate shell to form a branched network of channels between an inner shell and a neighboring outer shell. The presence of the channels forms resonators by which the sound is reflected in a targeted manner in order to silence the disturbing exhaust noise through interference.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
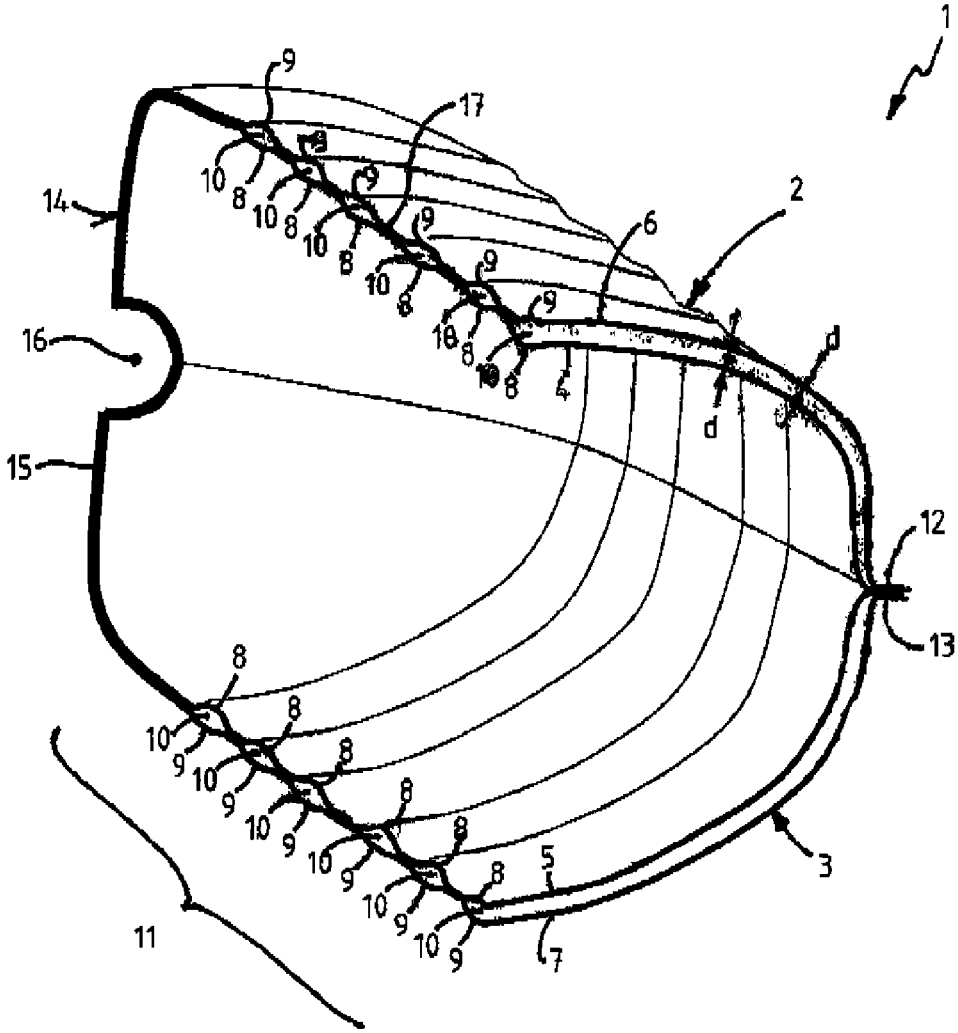
FIG. 1 is a perspective representation of a portion of an exhaust-noise attenuation muffler according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a perspective representation of a portion of an exhaust-noise attenuation muffler according to the present invention, generally designated by reference numeral 1. The exhaust-noise attenuation muffler 1 includes two half-shells 2, 3 to form a casing 11. The half-shell 2 is provided with an inner shell 4 and an outer shell 6, and half-shell 3 is provided with an inner shell 5 and an outer shell 7. Formed in complementing areas of the inner shells 4, 5 and the outer shells 6, 7 are embossments 8, 9 which define parallel channels 10 about the casing 11 of the exhaust-noise attenuation muffler 1. The inner shells 4, 5 and the outer shells 6, 7 are made by deep drawing sheet metal blanks 50 (FIG. 7) with a thickness d of 0.3 mm to 0.5 mm. The half-shells 2, 3 have border-side circumferential flanges 12, 13, where the half-shells 2, 3 are joined, in particular welded, together. Provided on one end 14 of the exhaust-noise attenuation muffler 1 is a bottom 15 which has a central opening 16 for outgoing exhaust. The inner shells 4, 5 are made of high-grade, especially heat-resistant and exhaust-resistant special steel, whereas the outer shells 6, 7 are made of ordinary steel.

Figure 1A:
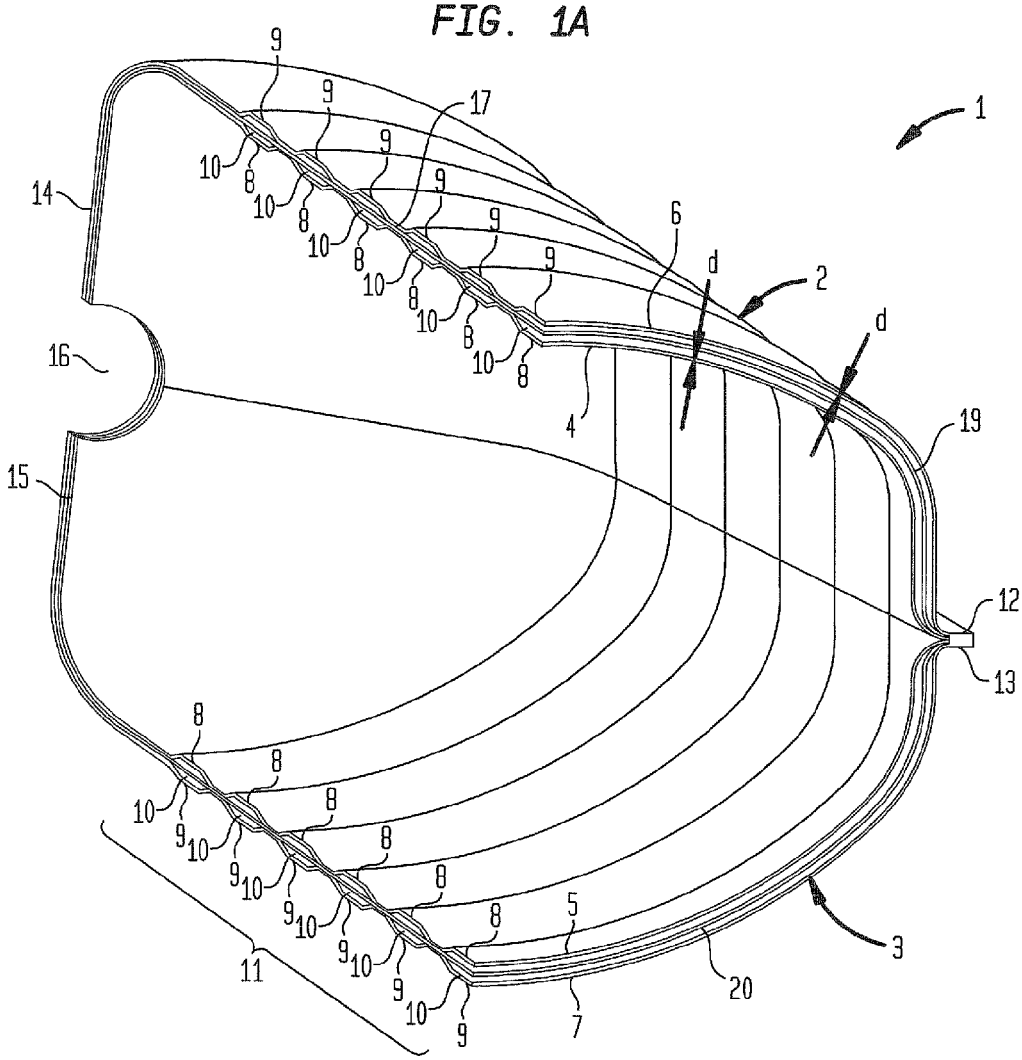
FIG. 1*a* is a perspective representation of a portion of a modification of an exhaust-noise attenuation muffler according to the present invention.
Figure 8:
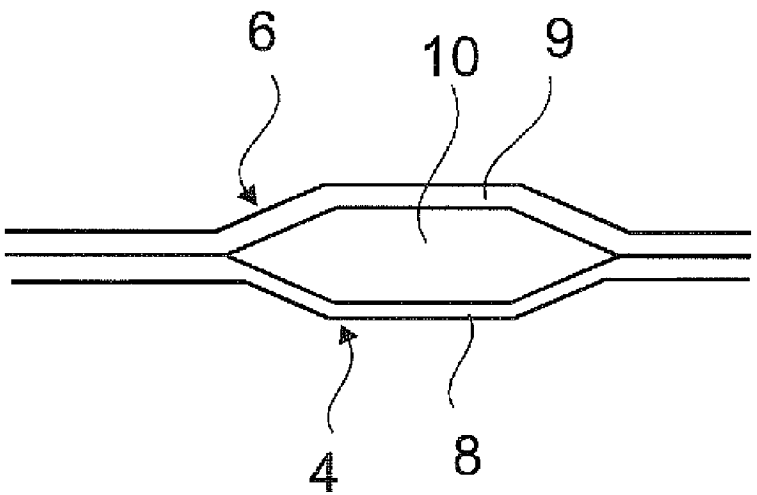
FIG. 8 is an enlarged detailed view of an area of a modification of an exhaust-noise attenuation muffler according to the present invention.

As shown in FIG. 1*a*, an intermediate shell 19 may also be arranged between the inner shell 4 and the outer shell 6 of half-shell 2, and an intermediate shell 20 may be arranged between the inner shell 5 and the outer shell 7 of half-shell 3. As shown by way of example in FIG. 8, the inner shell 4 has a zone which transmits radiating noise and which is made thinner. In this way, the transmission of sound waves from the inner side of the exhaust-noise attenuation muffler to the outer side is facilitated. Of course, any of the inner shells 4, 5, outer shells 6, 7 and/or intermediate shell 19 may be provided with a zone that is made thinner.

Figure 2:
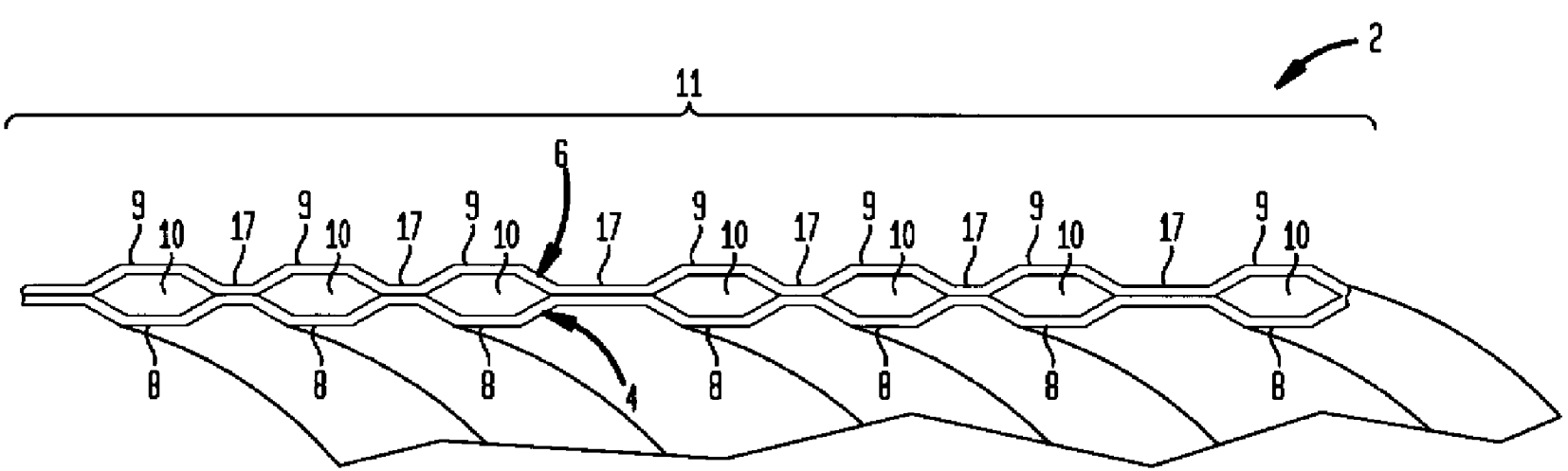
FIG. 2 is a cross sectional illustration of a casing of a half-shell.

FIG. 2 shows a detailed view of the casing 11 of a half-shell 2, illustrating in particular the presence of the embossments 8, 9 at complementing locations in the inner shell 4 and the outer shell 6. In the non-limiting example of FIG. 2, there are a total of seven channels 10 disposed in parallel relationship. The embossments 8, 9 in the inner shell 4 are hereby formed inwards and formed outwards in the outer shell 6. To enhance stability of the exhaust-noise attenuation muffler 1 (FIG. 1), the inner shells 4, 5 and the outer shells 6, 7 are joined together, in particular mechanically compressed together, also in the area of the casing 11 at contact points 17 (FIG. 2).

Figure 3:
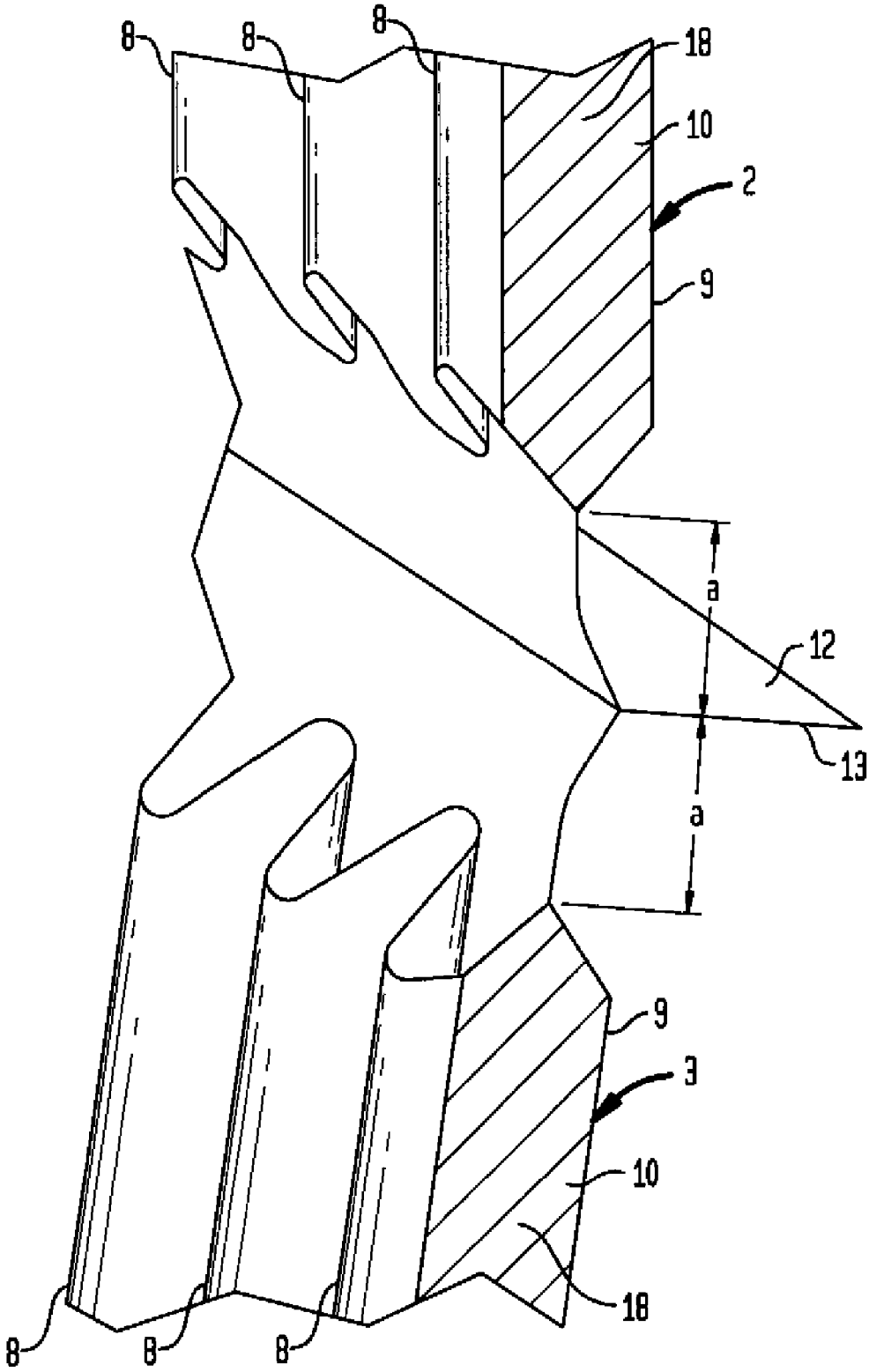
FIG. 3 is a schematic illustration of a flange region of the exhaust-noise attenuation muffler.

FIG. 3 is a schematic illustration of a flange region of the exhaust-noise attenuation muffler 1 in the area of the lateral flanges 12, 13 of the half-shells 2, 3. As can be seen, the embossments 8 in the inner shells 4, 5 and the embossments 9 in the outer shells 6, 7 end at a distance "a" to the flanges 12, 13, respectively. As a consequence, the inner shells 4, 5 and the outer shells 6, 7 rest directly upon one another in the area of the flanges 12, 13 so that the stability of the exhaust-noise attenuation muffler 1 is advantageously improved. Provided in the area of the flanges 12, 13 is a border-side, circumferential joint, in particular weld. The selection of the welding process is determined by the material being welded and the thicknesses "d" of the inner shells 4, 5 and the outer shells 6, 7. The presence of the embossments 8, 9 provides the establishment of channels 10 of significant volume. The channels 10 are filled by insulating material 18.

Figure 4:
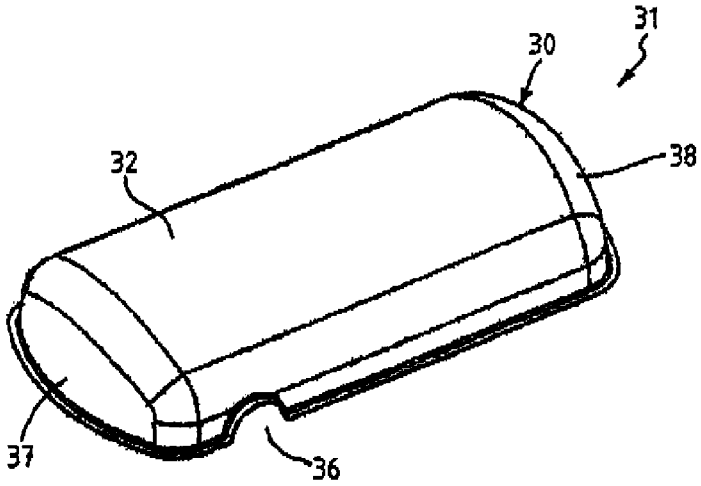
FIG. 4 is a perspective illustration of an upper half-shell.
Figure 5:
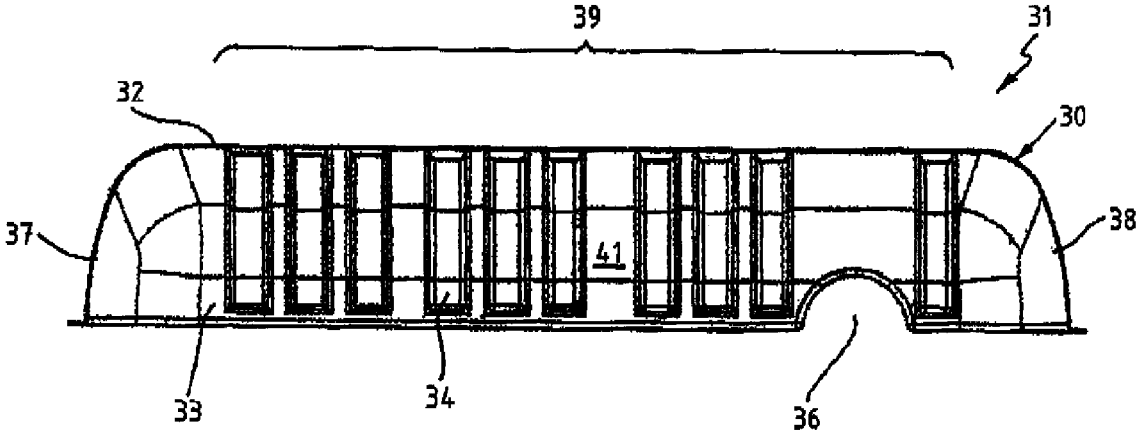
FIG. 5 is a longitudinal section of the half-shell of FIG. 4.
Figure 6:
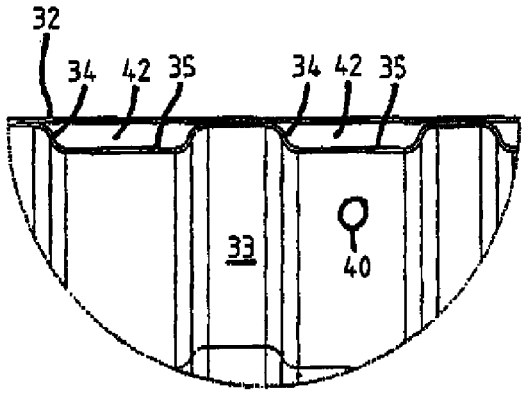
FIG. 6 is a cutaway view, on an enlarged scale, of a portion of the casing of the half-shell of FIG. 4.

FIGS. 4, 5, 6 show a half-shell 30 of an exhaust-noise attenuation muffler, generally designated by reference numeral 31 and having a smooth outer shell 32. The half-shell 30 constitutes the upper shell of the exhaust-noise attenuation muffler 31. The unillustrated lower shell is a mirror image of the upper shell 30. Only the inner shell 33 includes inwardly formed embossments 34 which have a wider embossment base 35. An exhaust inlet opening 36 is provided in the area of the casing 39, rather than in the area of the end portions 37, 38. An opening 40 is drilled in the inner shell 33 for ventilation and transmission of exhaust noise from the inner space 41 of the exhaust-noise attenuation muffler 31 into a channel 42 formed between the inner shell 33 and the outer shell 32.

Figure 7:
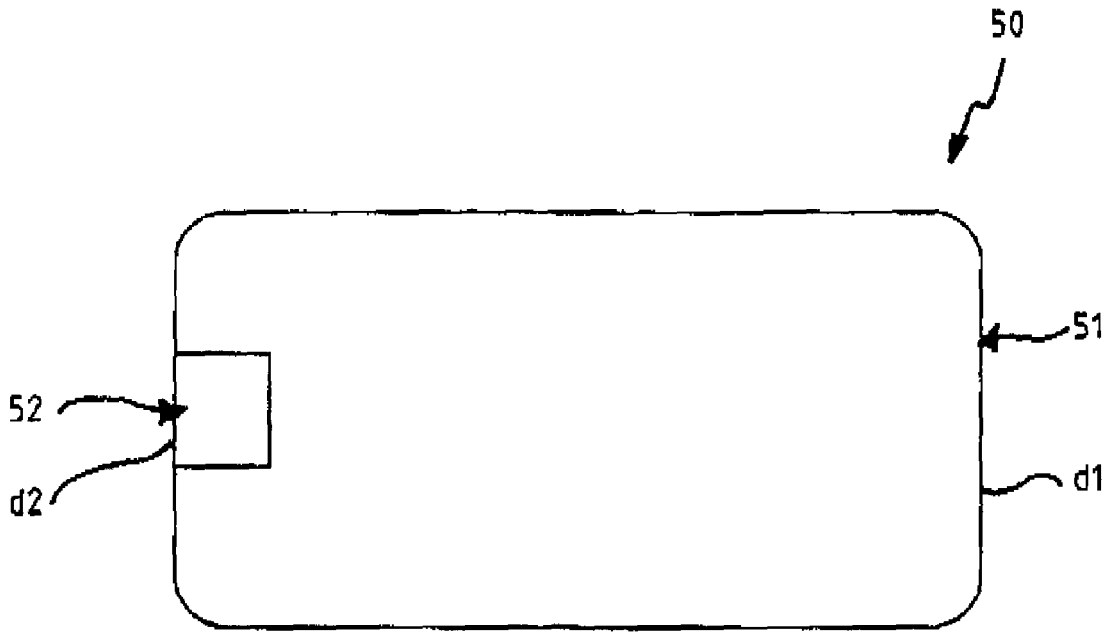
FIG. 7 is a schematic illustration of a sheet metal blank.

FIG. 7 is a schematic illustration of a sheet metal blank 50 in the form of a tailored blank. The sheet metal blank 50 includes two sheets 51, 52 which are welded together at their margin. The sheet 51 has a thickness d1 of 0.3 mm, whereas the sheet 52 has a thickness d2 of 0.35 mm.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method of making an exhaust-noise attenuation muffler, comprising the steps of:

deep drawing sheet metal blanks to form plural inner shells and plural outer shells;

forming at least one embossment in at least one member selected from the group consisting of at least one inner shell and at least one outer shell;

placing the inner shells in corresponding ones of the outer shells to form half-shells; and joining two complementing half-shells, wherein at least one member selected from the group consisting of inner shell and outer shell has a zone which transmits radiating noise and which is made thinner.

2. The method of claim 1, further comprising the step of forming embossments at corresponding areas in an inner shell and an outer shell to define a channel.

3. The method of claim 1, wherein at least one of the sheet metal blanks has a thickness between 0.3 mm and 0.5 mm.

4. The method of claim 1, wherein the sheet metal blank is a tailored blank.

5. The method of claim 1, wherein the sheet metal blanks are made of different materials.

6. The method of claim 1, further comprising the step of arranging at least one intermediate shell between an inner shell and an outer shell.

7. The method of claim 6, wherein the intermediate shell has a zone which transmits radiating noise and which is made thinner.

8. The method of claim 6, further comprising the step of arranging insulating material between two members selected from the group consisting of inner shell, outer shell, and intermediate shell.

9. The method of claim 6, further comprising the step of joining at least two members selected from the group consisting of inner shell, outer shell, and intermediate shell of a half-shell in a region of their casings, at least in some areas, before or during joining of the half-shells.

10. The method of claim 6, further comprising the step of providing an opening in at least one member selected from the group consisting of inner shell, outer shell, and intermediate shell.

11. The method of claim 6, further comprising the step of forming several embossments in at least one member selected from the group consisting of inner shell, outer shell, and intermediate shell to form a branched network of channels between an inner shell and a neighboring outer shell.

12. An exhaust-noise attenuation muffler, comprising two half-shells, each including an inner shell and an outer shell made through deep drawing of sheet metal blanks, with one of the inner and outer shells being provided with an embossment, wherein one of the sheet metal blanks has a thickness between 0.3 mm and 0.5 mm, wherein at least one member selected from the group consisting of inner shell and outer shell has a zone which transmits radiating noise and which is designed thinner.

13. The exhaust-noise attenuation muffler of claim 12, wherein the inner and outer shells have embossments at complementing areas for formation of a channel.

14. The exhaust-noise attenuation muffler of claim 12, wherein the sheet metal blank is a tailored blank.

15. The exhaust-noise attenuation muffler of claim 12, further comprising an intermediate shell arranged between the inner shell and the outer shell of a half-shell.

16. The exhaust-noise attenuation muffler of claim 15, wherein the intermediate shell has a zone which transmits radiating noise and which is designed thinner.

17. The exhaust-noise attenuation muffler of claim 15, wherein the sheet metal blanks are made of different materials.

18. The exhaust-noise attenuation muffler of claim 15, further comprising insulating material arranged between two members selected from the group consisting of inner shell, outer shell, and intermediate shell.

19. The exhaust-noise attenuation muffler of claim 15, wherein at least two members selected from the group consisting of inner shell, outer shell, and intermediate shell of a half-shell are joined in a region of their casings at least in some areas thereof.

20. The exhaust-noise attenuation muffler of claim 15, wherein at least one member selected from the group consisting of inner shell, outer shell, and intermediate shell is formed with an opening.

21. The exhaust-noise attenuation muffler of claim 15, wherein at least one member selected from the group consisting of inner shell, outer shell, and intermediate shell has several embossments to form a branched network of channels between an inner shell and a neighboring outer shell.

* * * * *